US010342320B2

(12) United States Patent
Wang

(10) Patent No.: US 10,342,320 B2
(45) Date of Patent: Jul. 9, 2019

(54) TRANSFORMABLE MULTIFUNCTION BACKPACK

(71) Applicant: Zhenkun Wang, Ashburn, VA (US)

(72) Inventor: Zhenkun Wang, Ashburn, VA (US)

( * ) Notice: Subject to any disclaimer, the term of this patent is extended or adjusted under 35 U.S.C. 154(b) by 187 days.

(21) Appl. No.: 14/963,551

(22) Filed: Dec. 9, 2015

(65) Prior Publication Data

US 2017/0065062 A1 Mar. 9, 2017

(51) Int. Cl.

| | |
|---|---|
| ***A45F 4/02*** | (2006.01) |
| ***A45F 4/08*** | (2006.01) |
| ***A47D 13/02*** | (2006.01) |
| ***A45F 3/04*** | (2006.01) |

(52) U.S. Cl.

CPC ..... *A45F 4/02* (2013.01); *A45F 3/04* (2013.01); *A45F 4/08* (2013.01); *A47D 13/025* (2013.01); *A45F 2004/026* (2013.01)

(58) Field of Classification Search

CPC ..... A45F 3/04; A45F 4/08; A45F 4/02; A45F 2004/026; A45C 13/385; A47D 13/025; B62B 1/002; B62B 1/042; B62B 1/047; B62B 5/061; B62B 5/0023; B62B 2206/006; B62B 5/068

USPC ..... 224/153

See application file for complete search history.

(56) References Cited

U.S. PATENT DOCUMENTS

| | | | | |
|---|---|---|---|---|
| 2,545,336 A * | 3/1951 | Binder | B62B 7/10 | 220/9.2 |
| 4,261,447 A * | 4/1981 | Arias | A45C 5/14 | 16/113.1 |
| 7,226,073 B1 * | 6/2007 | Zahiri | A45C 5/14 | 190/115 |
| 2009/0212535 A1 * | 8/2009 | Darling, III | A61G 1/013 | 280/651 |
| 2010/0213680 A1 * | 8/2010 | Massara | B62K 3/002 | 280/87.041 |
| 2014/0299428 A1 * | 10/2014 | Gadbois | A45C 9/00 | 190/11 |

FOREIGN PATENT DOCUMENTS

| | | | |
|---|---|---|---|
| GB | 2508286 A * | 5/2014 | A45F 4/02 |

* cited by examiner

*Primary Examiner* — Nathan J Newhouse
*Assistant Examiner* — Matthew T Theis
(74) *Attorney, Agent, or Firm* — WPAT, PC

(57) ABSTRACT

The present invention discloses a transformable multifunction backpack, including a main backpack body, retractable rods, and detachable rods. The retractable rod has a fixed portion and a handle portion; the fixed portion is stored within the main backpack body, and the handle portion can extend out of the fixed portion telescopically. The retractable rod and the detachable rod are attached together with a lockable means, such as a lockable pin, for quick release and adjustment. The backpack also includes a rolling base board which can be placed under the backpack body, or been used as a skateboard. The retractable rod can also be used as a cane. The main backpack body also has a child strap for carrying a small child. The backpack main body is comprised of several different fabric pieces, connected together with a connecting means, such as zippers or buttons.

13 Claims, 9 Drawing Sheets

TRANSFORMABLE MULTIFUNCTION BACKPACK

CROSS REFERENCE TO RELATED APPLICATION

This application claims priority to Chinese Patent Application No. 201520685730.X filed in the Chinese Patent Office on Sep. 7, 2015, the entire content of which is incorporated herein by reference.

BACKGROUND OF THE INVENTION

The present invention is an innovative backpack design, particularly relating to a transformable versatile backpack with multiple functions. A traditional backpack is used to load books and other items as a form of luggage with the upper and lower ends of the shoulder straps fixedly connected to the backpack body, the shoulder straps are adjustable in terms of length, but are not removable; some of the backpacks also equips with a pull ring at the backpack bottom end, which the user can pull ring for lifting up the backpack. Backpacks come in a variety of models, with differing capacities advantage of being a convenient way to easily carry supplies. Some advanced designs, in order to reduce the burden on the users, include built-in handle rods and roller wheels at the base of the backpack, which allow the users to roll the backpacks. This is a similar design as a rolling luggage, where the luggage is generally larger and with a higher load and the heavier weight. A rolling luggage with a mobile wheel and handle can be easily pulled or pushed on a flat surface, which increases the cargo carrying volume and is easier for the user to moves the enclosed cargo. The above backpacks and rolling luggage have their design advantages, but their functionalities are relatively limited as to only carrying cargo.

BRIEF SUMMARY OF THE INVENTION

The purpose of the present invention is to enhance and to expand the backpack's functionality by providing a transformable versatile backpack.

The present invention provides a transformable multifunction backpack with the following technical features to achieve the above purpose.

A transformable multifunction backpack includes a main backpack body, shoulder straps, retractable rods, detachable rods, and detachable base rolling board equipped with wheels. The main backpack body is constructed with several different pieces of fabrics connecting together with an attaching means such as zipper. The main backpack body also has a base rolling board attaching means, such a slot, a bracket, a packet, zipped secured strips, or Velcro® secured straps, on the side of the main backpack body for storing or attaching the detachable base rolling board. The bottom of the main backpack body also has an attaching means, such as a slot, a bracket, or a packet, a zipper, or Velcro®, for attaching the detachable base rolling board. The detachable base rolling board also equips with an attaching means, such as a slot or a groove, for securing attached to the main backpack body or any other parts of the backpack. The retractable rod comprises a handle portion and a main fixed portion. The fixed portion is positioned within the main backpack body; the handle portion is stored within the fixed portion, and can extend out of the fixed portion telescopically, and protruded out from the top of the main backpack body. The detachable rod comprises a main elongated portion and a first end and a second end. The first end is attaching to the retractable rod via a pin or any other attaching means, and the second end can equip with a wheel. The transformable multifunction backpack can also equip with a child strap; and the two main retractable rods and the fabric component of the main backpack body between two main retractable rods can function as a stretcher.

DETAILED DESCRIPTION OF THE INVENTION

Figure 1:
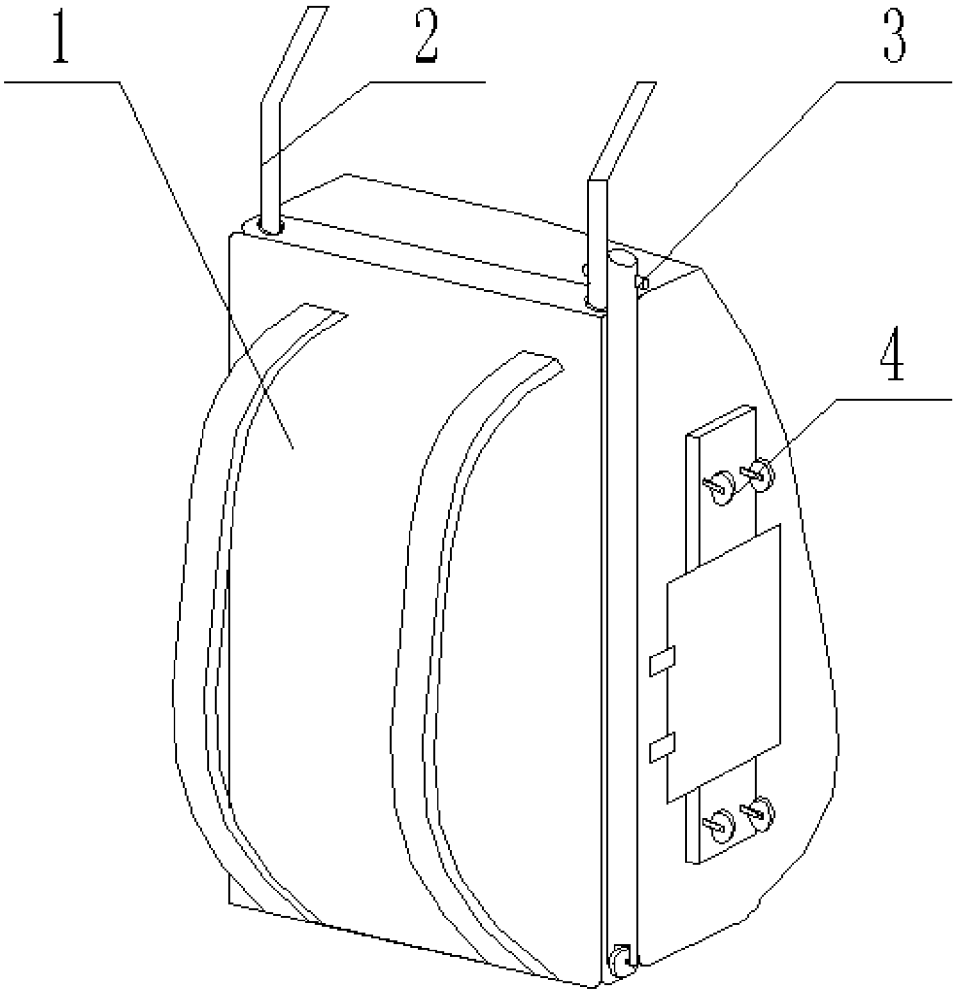
FIG. 1 is a schematic drawing of the external perspective view of the rear surface of the current invention.

FIG. 1 shows the current invention in a backpack configuration, including a main backpack body 1, retractable rods 2, detachable rods 3, and a detachable base rolling board 4. The detachable rod is connected to the retractable rod via a pin in this embodiment. In this configuration, the retractable rod and the detachable rod are arranged in parallel. The detachable base rolling board is inserted into a slot or a packet on the side of the main backpack body. The slot or the packet has a detachable edge that can be adjusted or open to accommodate the detachable base rolling board.

The retractable rod 2 has a handle portion and a fixed portion. The fixed portion is placed and fixed within the main backpack body. The handle portion can be extended telescopically out of the fixed portion. Additional case or bracket or horizontal hidden beam (not shown) can be placed between the two retractable rods within the main backpack body for increasing the rigidity.

Figure 2:
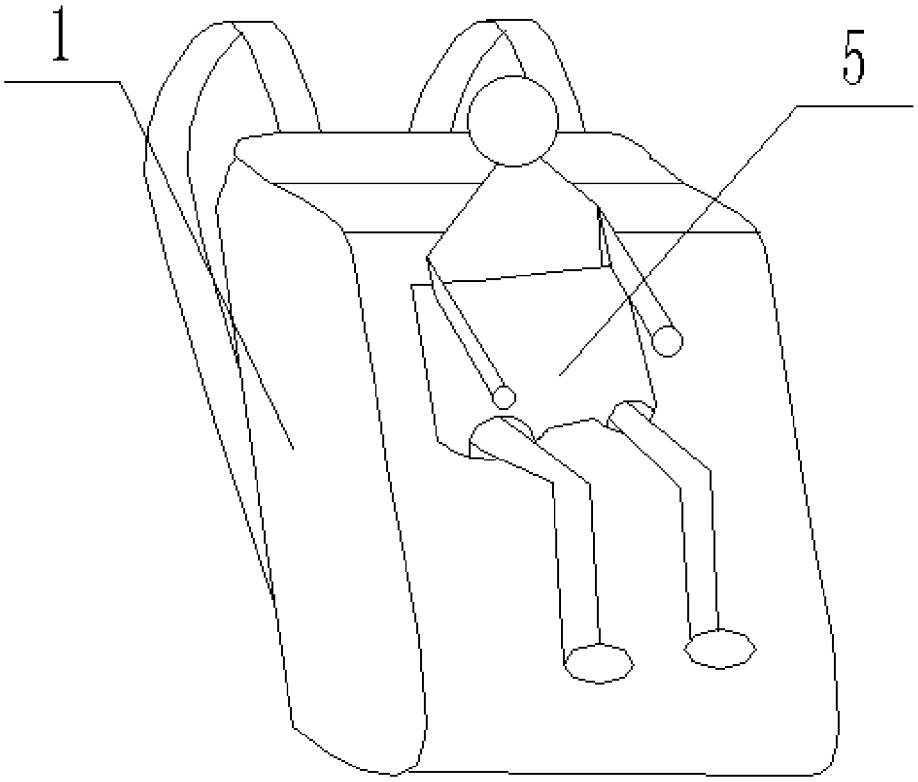
FIG. 2 is a schematic drawing of the external perspective view of the current invention with a child strap.

FIG. 2 shows the current invention with a child strap 5. While the backpack user carries the current invention in a backpack configuration, the current invention provides a child strap where user can carry a child by placing the child in the child strap 5. The child can sit in the child strap 5, and child's legs are extending out of the child strap while sitting in it. FIG. 2 also shows that both the retractable rods and the detachable rods are completely stored into the main backpack body.

Figure 3:
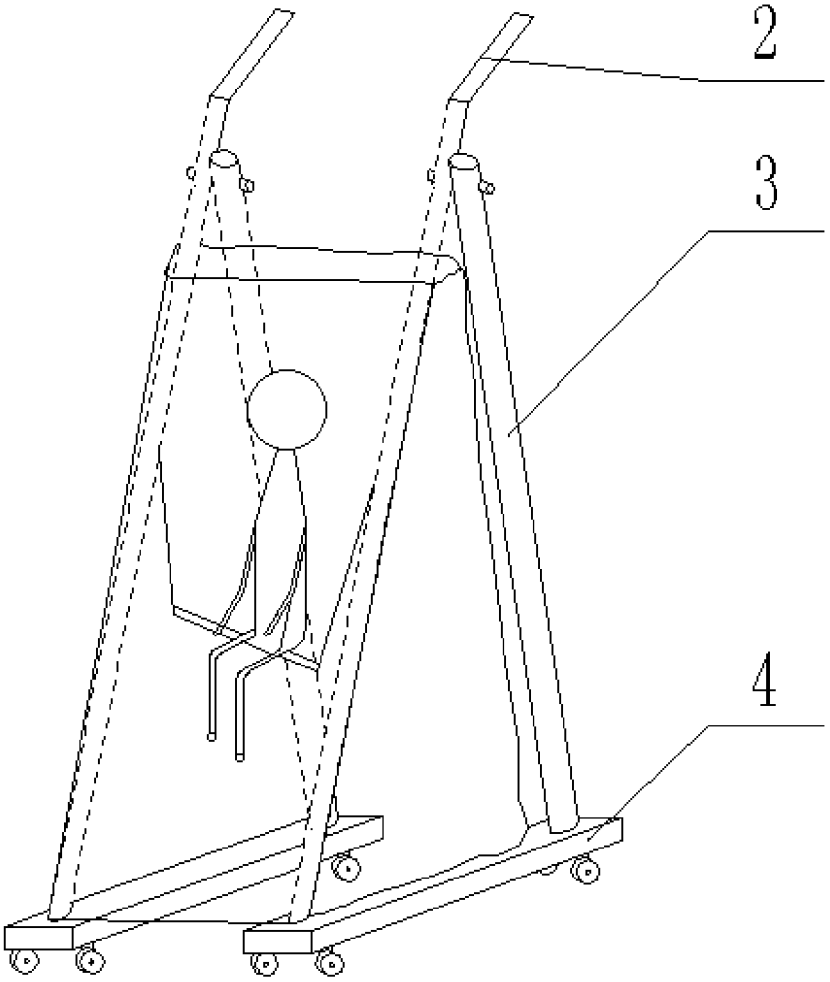
FIG. 3 is a schematic drawing of the current invention in a chair and stroller configuration.

FIG. 3 shows the current invention in a stroller configuration or swinging configuration. FIG. 3 shows that the detachable base rolling boards are placed under the main backpack body, and the detachable rods are pushing backward to form a triangle with the retractable rods and the detachable base rolling boards. The detachable rod is connecting with the retractable rod with lockable means, such as a lockable pin, for quick release and position adjustment.

The main backpack body is comprised of a plurality of fabric pieces connected together with a connecting means, such as zipper or buttons. The FIG. 3 shows that the front fabric portion is removed to accommodate a seating. The fabric portion which attaches to the retractable rods can be further adjusted. As shown in the FIG. 3, this fabric portion is not complete attached and secured to the retractable rods, which then can function as swing. The handle on the handle portion can also be adjusted and twisted around. In this embodiment, the rolling base board has slots to accommodate the connection with both the retractable rod and the detachable rod.

Figure 4:
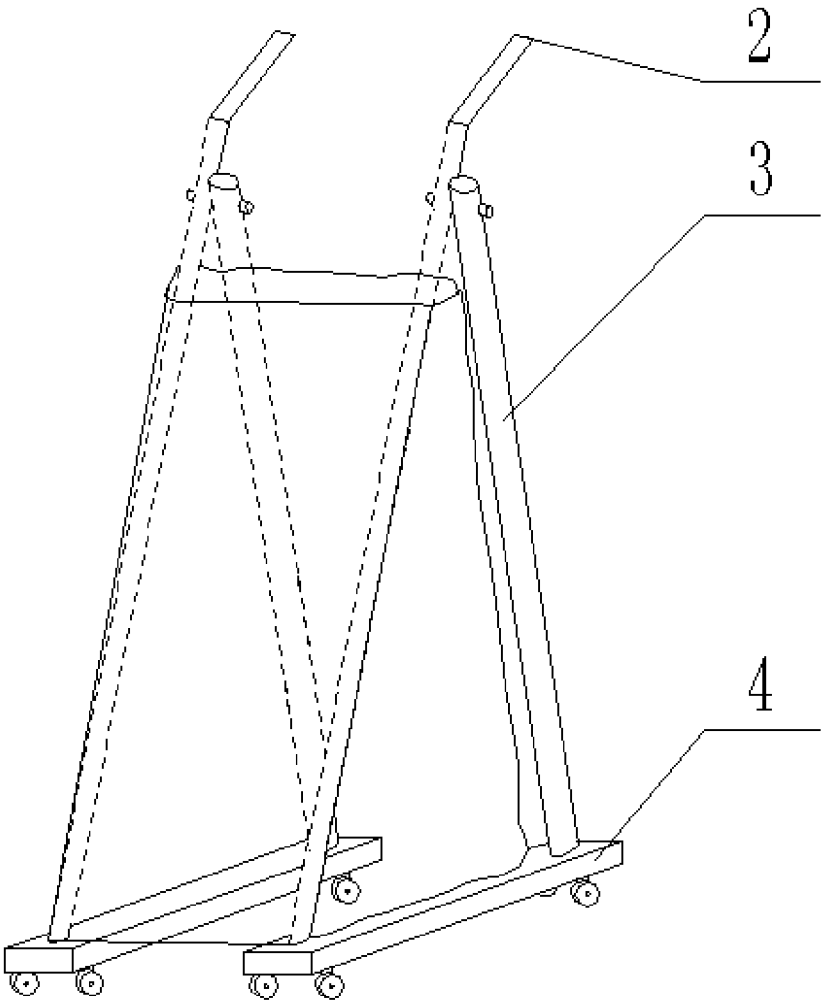
FIG. 4 is a schematic drawing of the current invention in a shopping cart configuration.

FIG. 4 shows the current invention in a shopping cart configuration. Similar to the stroller configuration shown in FIG. 3, the shopping cart configuration also has the retractable rod, detachable rod and detachable base rolling board arranged in a triangular formation. The main backpack body is supported by this triangular formation for storing goods with an opening at the top. User can then push the backpack as a shopping cart by pushing the handle section 2.

Figure 5:
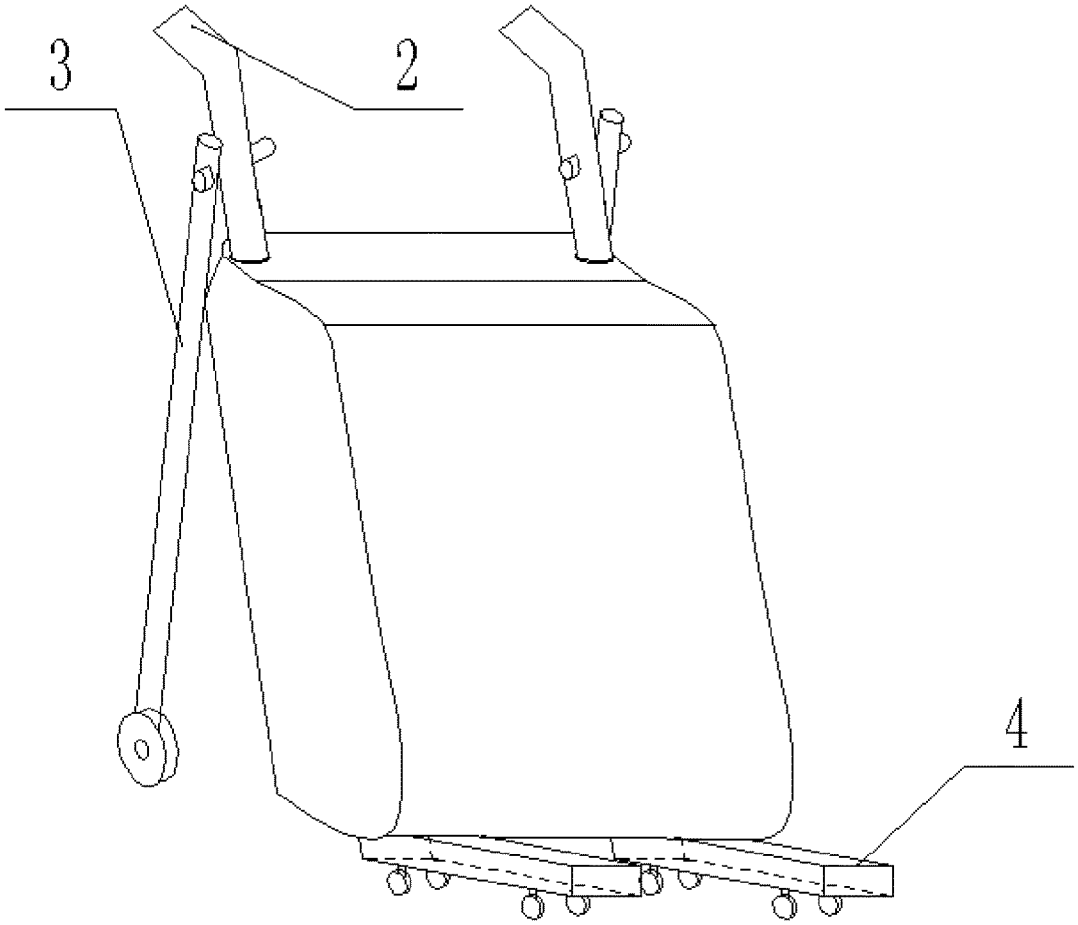
FIG. 5 is a schematic drawing of the current invention in a rolling luggage configuration.

FIG. 5 shows the current invention in a rolling luggage configuration. Similar to the stroller configuration shown in FIG. 3 and the shopping cart configuration shown in the FIG. 4, the rolling luggage configuration also has the retractable rod, detachable rod and detachable base rolling board arranged in a triangular formation. The main backpack body is supported by this triangular formation for storing goods. There is no opening at the top of the backpack body. The backpack body is further supported by the internal bracket to protect the goods stored within. The detachable rods 3 are not attached onto the base rolling board. Rather, the detachable rods 3 are further pushed back to position the backpack body in a relatively flatter position for easier maneuvering. User can then push the backpack as a rolling luggage by pushing the handle section 2. In a different embodiment, the current configuration can also function as a dolly, which the backpack body is removed, and the base rolling board, retractable rods, and detachable rods function as a dolly for moving any heavy boxes or third party luggages.

Figure 6:
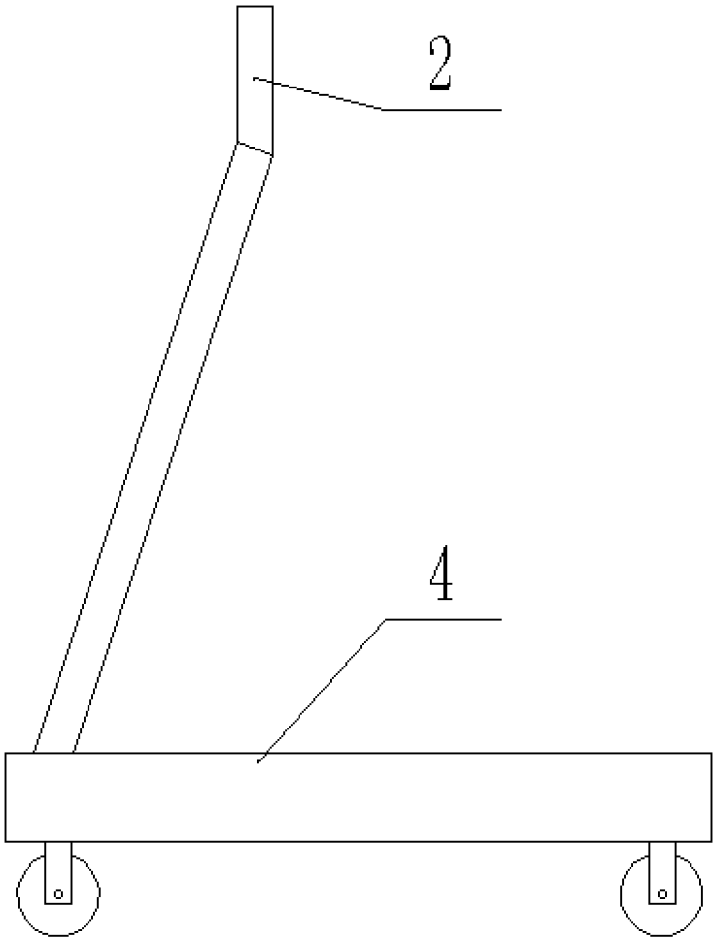
FIG. 6 is a schematic drawing of the current invention in a scooter configuration.
Figure 7:
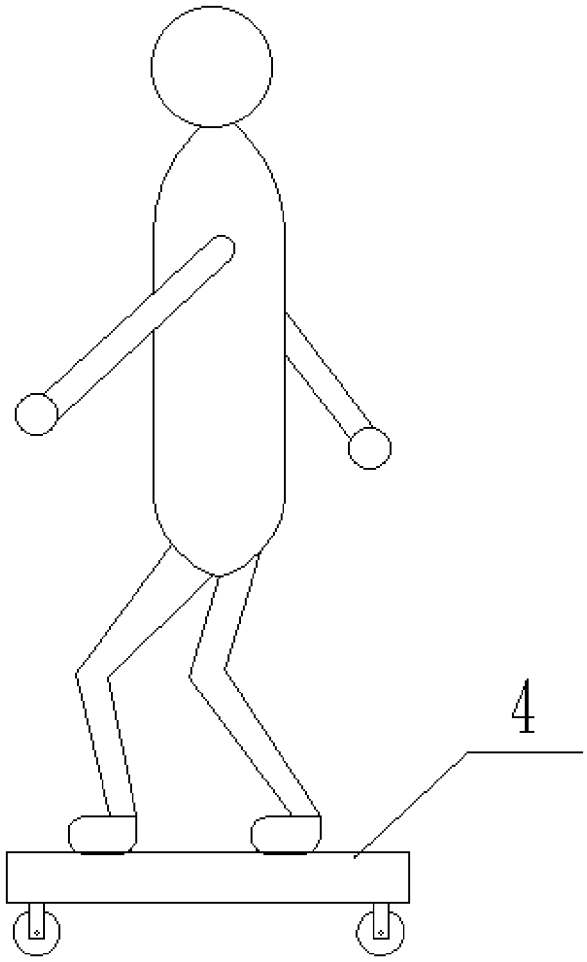
FIG. 7 is a schematic drawing of the current invention supporting the operation as a skateboard.

FIGS. 6 and 7 show the current invention in a scooter configuration and skateboard operation. As shown in the FIG. 6, the retractable rod 2 are removed out of the backpack main body and attached to the base rolling board. FIG. 7 shows user using the base rolling board as a skateboard. In both cases, the main backpack body can still be carried by the user as shown in the FIG. 7.

Figure 8:
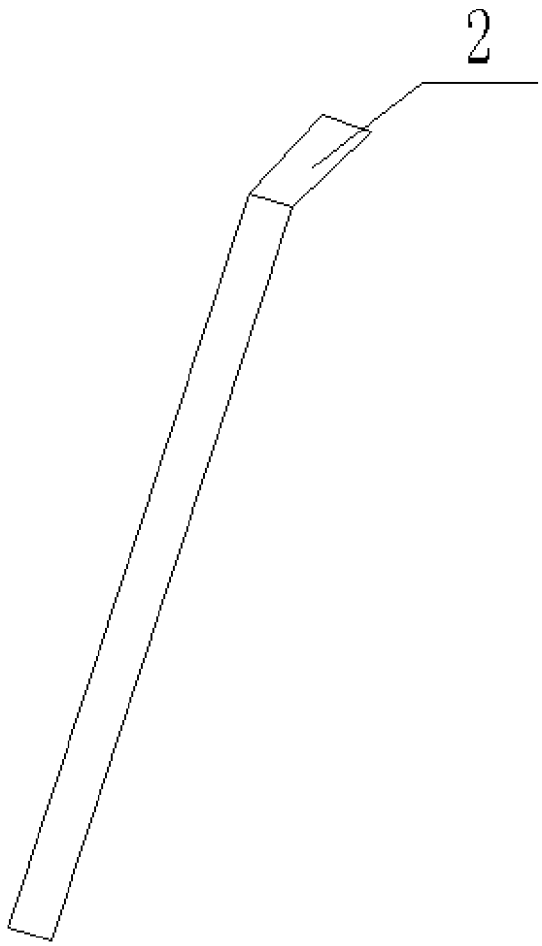
FIG. 8 is a schematic drawing of the handle portion of the retractable rod of the current invention.

FIG. 8 shows the retractable rod been removed out of the main backpack body. The retractable rod with the handle section is then functioning as a cane.

Figure 9:
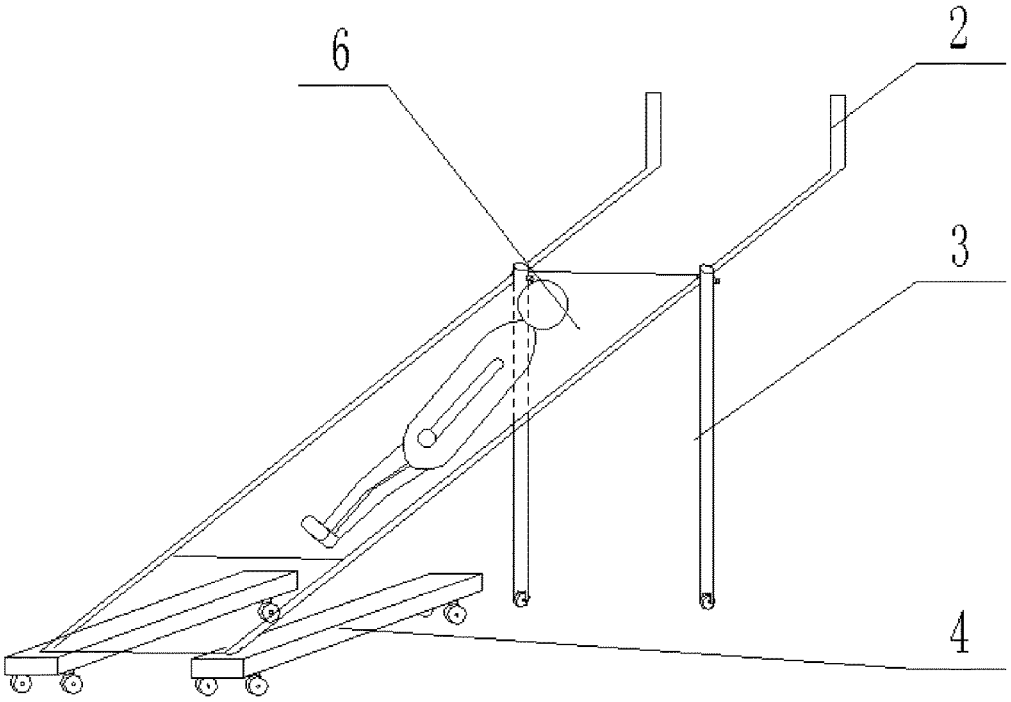
FIG. 9 is a schematic drawing of the current invention in a stretcher configuration.

FIG. 9 shows the current invention in a stretcher configuration. Similar to the stroller configuration shown in FIG. 3, the shopping cart configuration shown in the FIG. 4, and the rolling luggage configuration shown in FIG. 5, the stretcher configuration also has the retractable rod, detachable rod and detachable base rolling board arranged in a triangular formation. The main backpack body is functioning as the stretcher's main carrying section, and is supported by retractable rods 2. The detachable rods 3 are not attached onto the base rolling board; the detachable rods 3 are further pushed back to position the stretcher's main carrying section in a relatively flatter position for carrying the patient. User can then push the backpack stretcher by pushing the handle section 2.

Shown above and described are the basic principles of the present invention, the main features and advantages. One experience in the art should understand that the new types are not limited to the embodiments described above, the embodiments described above and described in the specification are merely illustrative of the principles of the present invention, without departing from the spirit and scope of the invention, and the premise of this practical invention, there will be a variety of new changes and improvements, these changes and modifications are within the claimed range of the present invention. The present invention's protection scope is defined by the appended claims and their equivalent definitions.

What is claimed is:

1. A transformable multifunction backpack, comprising:

a backpack main body, comprising a plurality of sections connecting together;

a first retractable rod and a second retractable rod, each including a fixed portion and a handle portion, wherein said handle portion extends out of said fixed portion telescopically, and each of said fixed portions is positioned at a corner of said backpack main body and within said backpack main body;

a first detachable rod and a second detachable rod, each including a first end and a second end, wherein both said first detachable rod and said second detachable rod are linear, each of said first ends directly connects to one of said first retractable rod and said second retractable rod via a connection, and each of said second ends are not attached to anything;

wherein each of said detachable rods is completely detachable from a corresponding retractable rod, each of said detachable rods is positioned outbound of said backpack main body, and each of said detachable rod rotates about said connection from parallel to said corresponding retractable rod to non-parallel in a first rotation direction and from parallel to non-parallel in a second rotation direction; and wherein the length of both of the detachable rods is longer than the height of the backpack main body, and the connection is positioned exterior to the backpack main body.

2. The transformable multifunction backpack according to claim 1, wherein said plurality of sections are fabric sections, and said fabric sections are connected together with zippers or buttons.

3. The transformable multifunction backpack according to claim 1, further comprising a child strap.

4. The transformable multifunction backpack according to claim 1, further comprising a detachable rolling base board, wherein said detachable rolling base board is stored in a slot of the backpack main body.

5. The transformable multifunction backpack according to claim 1, further comprising a detachable rolling base board, wherein said detachable rolling base board is attached to the bottom of said backpack main body.

6. The transformable multifunction backpack according to claim 5, wherein said detachable rods are pushed backward, and both said detachable rod and said retractable rod are attached to the rolling base board to form a triangular shape.

7. The transformable multifunction backpack according to claim 6, wherein a front portion of said backpack main body forms a seat upon removal.

8. The transformable multifunction backpack according to claim 6, wherein a top of said backpack main body is open to form a shopping bag.

9. The transformable multifunction backpack according to claim 6, wherein said backpack main body is removable from said detachable rods, and said retractable rods and said detachable rolling base board form a dolly.

10. The transformable multifunction backpack according to claim 5, wherein said backpack main body is secured on said retractable rods to form a stretcher.

11. The transformable multifunction backpack according to claim 1, wherein one of said retractable rods is removed out of said backpack main body to form a cane.

12. The transformable multifunction backpack according to claim 1, wherein said second ends are coterminous with a bottom of said backpack main body when said detachable rods are parallel to said retractable rods.

13. A transformable multifunction backpack, comprising:

a backpack main body with a right side and a left side, wherein said right side and said left side are not adjacent to each other;

a first retractable rod, positioned within said backpack main body and adjacent to said right side;

a second retractable rod, positioned within said backpack main body and adjacent to said left side;

a first detachable rod, positioned outside of said backpack main body, adjacent to said right side, and connecting to said first retractable rod via a first connection, wherein a length of said first detachable rod is longer than a height of said backpack main body; and a second detachable rod, positioned outside of said backpack main body, adjacent to said left side, and connecting to said second retractable rod via a second connection;

wherein both said first detachable rod and said second detachable rod are linear; and each of said first detachable rod and said second detachable rod has one end free from attaching to anything.

* * * * *